US007313834B2

(12) United States Patent
Tan et al.

(10) Patent No.: US 7,313,834 B2
(45) Date of Patent: Jan. 1, 2008

(54) BATHTUB WATER TAP

(75) Inventors: Wang-Hong Tan, Shenzhen (CN); Gen-Wei Zhau, Shenzhen (CN)

(73) Assignee: Globe Union Industrial Corp., Taichung (TW)

( * ) Notice: Subject to any disclaimer, the term of this patent is extended or adjusted under 35 U.S.C. 154(b) by 393 days.

(21) Appl. No.: 10/968,935

(22) Filed: Oct. 21, 2004

(65) Prior Publication Data

US 2006/0085906 A1 Apr. 27, 2006

(51) Int. Cl.
*E03C 1/04* (2006.01)

(52) U.S. Cl. ..... 4/678; 137/801; 239/588

(58) Field of Classification Search ..... 4/567, 4/568, 570, 678; 137/597, 801; 239/588
See application file for complete search history.

(56) References Cited

U.S. PATENT DOCUMENTS 2,173,064 A * 9/1939 Judell ..... 137/597 X
6,668,393 B1 * 12/2003 Mascari et al. ..... 4/678

* cited by examiner

*Primary Examiner*—Robert M. Fetsuga
(74) *Attorney, Agent, or Firm*—Troxell Law Office, PLLC

(57) ABSTRACT

A bathtub water tap includes a tap body, a fluid control device, a showerhead hose and a showerhead. The tap body has a hose passage and a water passage. The water passage has an outlet and an inlet for transporting water diverted by the fluid control device. The hose passage has a socket hole and a through hole. The showerhead hose is slidably mounted in the hose passage and has two opposite ends respectively connected to the showerhead and the fluid control device. The showerhead has an inside end held in the socket hole of the hose passage to position the showerhead with the tap body. Consequently, additional installations of the showerhead are not required. The showerhead will not occupy bathroom space, and the appearance of the entire water tap is tidy and clean.

16 Claims, 5 Drawing Sheets

BATHTUB WATER TAP

BACKGROUND OF THE INVENTION

1. Field of the Invention

The present invention relates to a water tap, and more particularly to a bathtub water tap which regulates cold and hot water and has a tap body and a showerhead combined with the tap body to render a tidy appearance of the entire water tap and save storage space for the showerhead when the showerhead is not in use.

2. Description of Related Art

Various taps or faucets are provided for different applications. For example, a conventional bathtub water tap in accordance with prior art can be generally found in a bathroom. The conventional bathtub water tap includes a tap body, a fluid control device, a showerhead and a showerhead hose. The tap body has a water passage with an outlet and an inlet. The inlet of the water passage is connected to the fluid control device. The showerhead hose has two opposite ends, and one end is connected to the fluid control device and the other end is connected to the showerhead.

The fluid control device regulates the hot and the cold water and diverts the mixing water entering into either the inlet of the water passage or the showerhead hose. Therefore, a user can enjoy hip bath or shower bath by selecting the water flowing out through the outlet of the water passage in the tap body or the showerhead. Such a conventional water tap could be found in U.S. Pat. No. 6,079,061 to Fan and U.S. Pat. No. 6,321,777 to Wu.

However, the showerhead of the conventional bathtub water tap is installed through an additional fixing member such as a wall fixture. Fixing the wall fixture needs to drill holes in a wall and uses fasteners such as screws to fasten the wall fixture on the wall through the holes. Installation of the wall fixture is really inconvenient and needs tools such as electronic drills to define the holes and screwdrivers to tighten the screws. Furthermore, positions of the wall fixture will not be easy to adjust because the holes in the wall should be defined prior to changing the positions of the wall fixture. Moreover, the showerhead, the showerhead hose and the wall fixture occupy quite a lot of limited bathroom space when the showerhead is not in use.

SUMMARY OF THE INVENTION

An object of the present invention is to provide a water tap which modularizes a tap body and a showerhead to render a clean appearance of the entire water tap.

An other object of the present invention is to provide a water tap which combines a tap body and a showerhead to save storage space for the showerhead and reduce installations of the showerhead.

To achieve the above-mentioned objects, a bathtub water tap in accordance with the present invention includes a tap body, a fluid control device, a showerhead hose and a showerhead. The tap body has a hose passage and a water passage. The water passage has an outlet and an inlet for transporting water diverted by the fluid control device. The hose passage has a socket hole and a through hole. The showerhead hose is slidably mounted in the hose passage and has two opposite ends passing respectively through the socket hole and the through hole of the hose passage. The ends of the showerhead hose are respectively connected to the showerhead and the fluid control device. The showerhead has an inside end held in the socket hole of the hose passage to position the showerhead with the tap body to achieve the objects.

Other objects, advantages and novel features of the present invention will be drawn from the following detailed embodiment of the present invention when taken in conjunction with the accompanying drawings.

DESCRIPTION OF THE PREFERRED EMBODIMENTS

Figure 1:
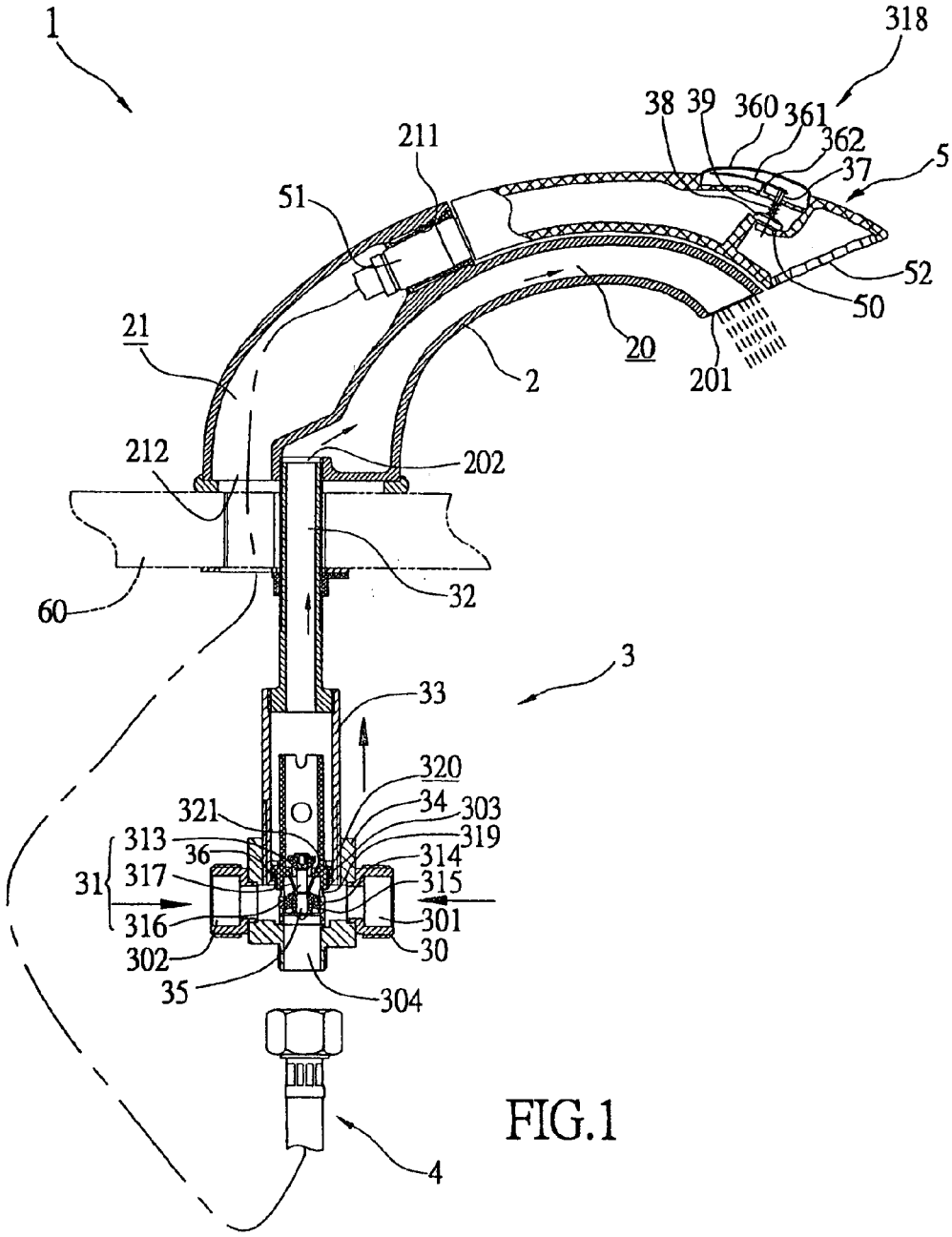
FIG. 1 is a cross sectional view of a bathtub water tap in accordance with the present invention.

With reference to FIG. 1, a bathtub water tap 1 in accordance with the present invention includes a tap body 2, a fluid control device 3, a showerhead hose 4 and a showerhead 5.

The tap body 2 has a water passage 20 and a hose passage 21. The water passage 20 is defined completely through the tap body 2 and defines an outlet 201 and an inlet 202 in the tap body 2. Water enters into the water passage 20 through the inlet 202 and flows out of the water passage 20 through the outlet 201.

The hose passage 21 is integrally defined in and completely through the tap body 2 adjacent to the water passage 20, is shorter than the water passage 20 in length and defines a socket hole 211 and a through hole 212 in the tap body 2. The through hole 212 is defined adjacent to the inlet 202 of the water passage 20. The socket hole 211 faces toward the outlet 201 of the water passage20.

The showerhead hose 4 is slidably mounted and held in the hose passage 21 and has two opposites ends. The ends of the showerhead hose 4 pass respectively through the socket hole 211 and the through hole 212 and are respectively connected to the showerhead 5 and the fluid control device 3.

The fluid control device 3 is connected to the inlet 202 in the tap body 2 and diverts water flow directions to either the water passage 20 or the showerhead hose 4. The fluid control device 3 includes two plumbing couplings 30, a piston mechanism 31, a mounting pipe 32, a receiving pipe 33 and a joint 34.

The plumbing couplings 30 include a cold water inlet 301 and a hot water inlet 302 and are mounted in the joint 34. The joint 34 has a tap body outlet 303 and a showerhead outlet 304. The inlets 301,302 and the outlets 303,304 in the joint 34 are communicated with each other and may be arranged in a cross. The cold and the hot water inlets 301,302 are respectively in communication with a cold water supply conduit (not shown) and a hot water supply conduit (not shown) that transport respectively hot and cold water.

The receiving pipe 33 is mounted in the joint 34 through the tap body outlet 303. The showerhead hose outlet 304 is connected with one end of the showerhead hose 4. Therefore, water will enter into the showerhead 5 through the showerhead hose 4 for shower both when the water is directed by the piston mechanism 31.

The showerhead 5 is demountably mounted on the tap body 2, is partially held in the socket hole 211 of the hose passage 21 and has an inside end 51 and a spout face 52. The showerhead 5 forms a part of the tap body 2 while the inside end 51 is held in the socket hole 211, which will provide a nice appearance of the entire tap body 2 and save the bathroom space. The spout face 52 may be flush with the outlet 201 in the tap body 20 so that the showerhead 5 and the tap body 2 cooperatively form a complete profile.

The mounting pipe 32 is mounted in a deck 60 and is connected to both the receiving pipe 33 and the inlet 202 of the water passage 20 in the tap body 2 to direct the water in the receiving pipe 33 entering into the water passage 20.

The piston mechanism 31 includes a piston body 313, a shaft connection pipe 314, a movable block 315, a valve rod 316, a resilient member 317 and a differential pressure switch 318. The shaft connection pipe 314 is mounted in the receiving pipe 33 with a sealing 36 such as an O-ring and has two opposite openings, multiple radial holes 319, a valve port 320 and an interior shoulder 321. The sealing 36 is mounted on the receiving pipe 33 around the tap body outlet 303 to prevent water from leaking through the tap body outlet 303. The openings of the shaft connection pipe 314 are respectively communicated with the inlet 202 in the tap body 2 through the mounting pipe 32 and the showerhead outlet 304 in the joint 34. The shoulder 321 is annular and is formed inside the shaft connection pipe 314 so as to form the valve port 320. The radial holes 319 allow communicating the inside of the shaft connection pipe 314 to both the hot and the cold water inlets 302,301.

The valve rod 316 is movably mounted and held in the valve port 320 with its two ends extended respectively toward the openings of the shaft connection pipe 314. The piston body 313 and the movable block 315 are respectively attached to the ends of the valve rod 316. The piston body 313 either opens or closes the valve port 320 as the valve rod 316 is moved upwardly or downwardly caused by differences of water pressure. The movable block 315 has a channel 35 that communicates with the showerhead outlet 304 in the joint 34.

The resilient member 317 such as a leaf spring and is mounted on the valve rod 316 between the movable block 315 and the shoulder 321 to provide a restitution force pushing the movable block 315, which causes the piston body 313 to close the valve port 320.

The differential pressure switch 318 is mounted in the showerhead 5 to produce a water pressure difference when the differential pressure switch 318 is pressed. The showerhead 5 further has a valve hole 50 adjacent to the spout face 52. The differential pressure switch 318 includes a latch lever 360, a resilient plate 361, a linkage rod 37, a valve plug 38 and a resilient member 39. The resilient plate 361 is supported by a nub 362 and abuts partially against the latch lever 360.

The linkage rod 37 is slidably mounted in the showerhead 5 with the resilient member 39 at a position corresponding to the valve hole 50 and is connected to the resilient plate 361. Therefore, pivoting the resilient plate 361 about the nub 362 will move the linkage rod 37 and compress the resilient member 39. The valve plug 38 is attached to the linkage rod 37 so that the movements of the linkage rod 37 will cause the valve plug 38 opening or closing the valve hole 50.

The cold water and the hot water enter the connection pipe 314 through the cold and the hot water inlets 301,302 and the radial holes 319 when the water tap 1 is turned on. The piston body 313 is moved upward by the water pressure to open the valve port 320, which permits the mixing water entering into the water passage 20 through the pipes 32,33, and then flows out through the outlet 201. The movement of the piston body 313 moves the valve rod 316 upward, which compresses the resilient member 317 producing the restitution force.

Figure 2:
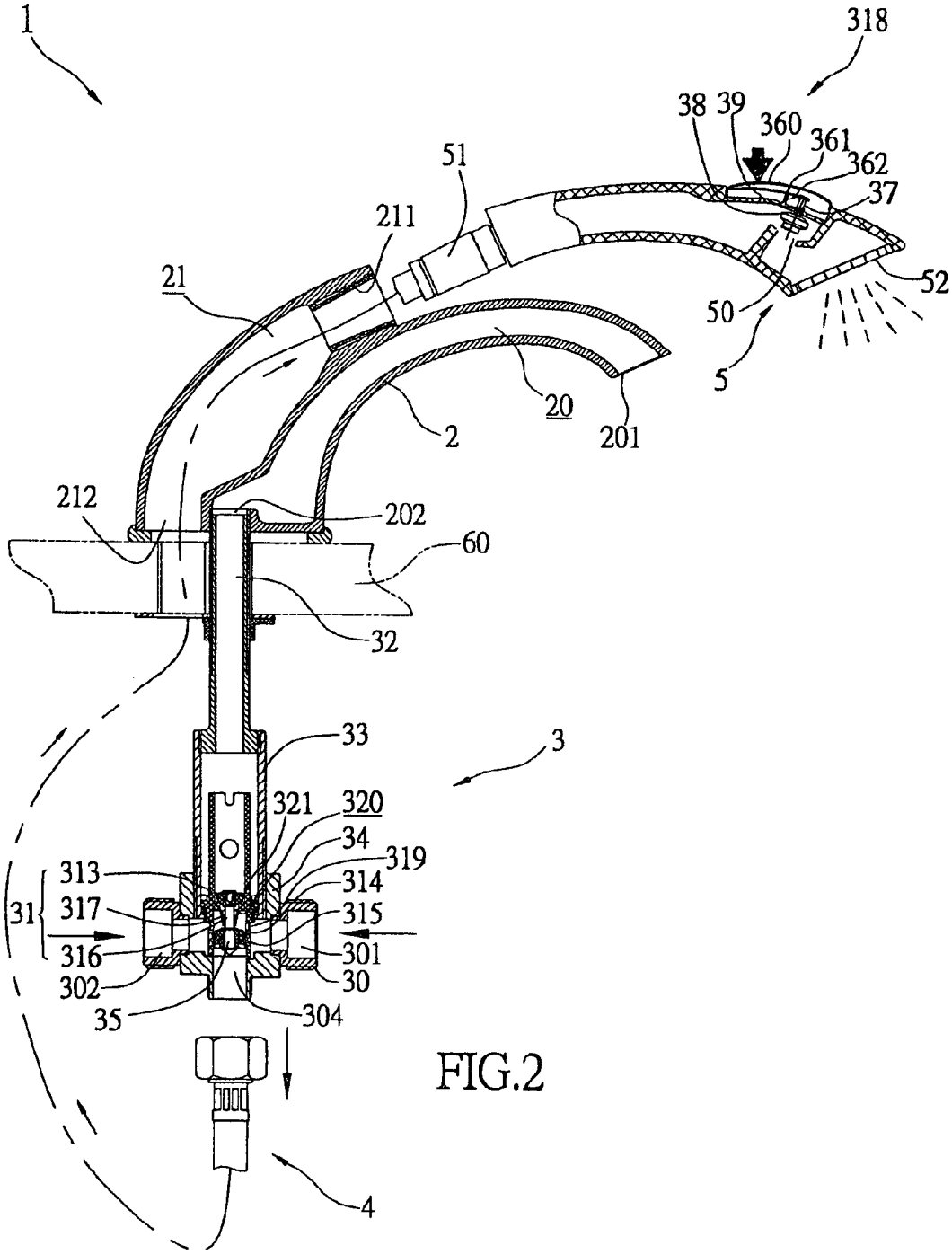
FIG. 2 is an operational, cross sectional view of the water tap in FIG. 1 when a showerhead is pulled out of a tap body.

With further reference to FIG. 2, pressing the latch lever 360 causes the valve plug 38 opening the valve hole 50. The opening of the valve hole 50 causes reduction of the water flow pressure, which results that the water flow pressure is insufficient to push the piston body 313 against the restitution force of the resilient member 317. The resilient member 317 returns the piston body 313 to its original position so that the piston body 313 closes the valve port 320. In such a state, the mixing water only flows out through the showerhead 5 for shower bath.

Figure 3:
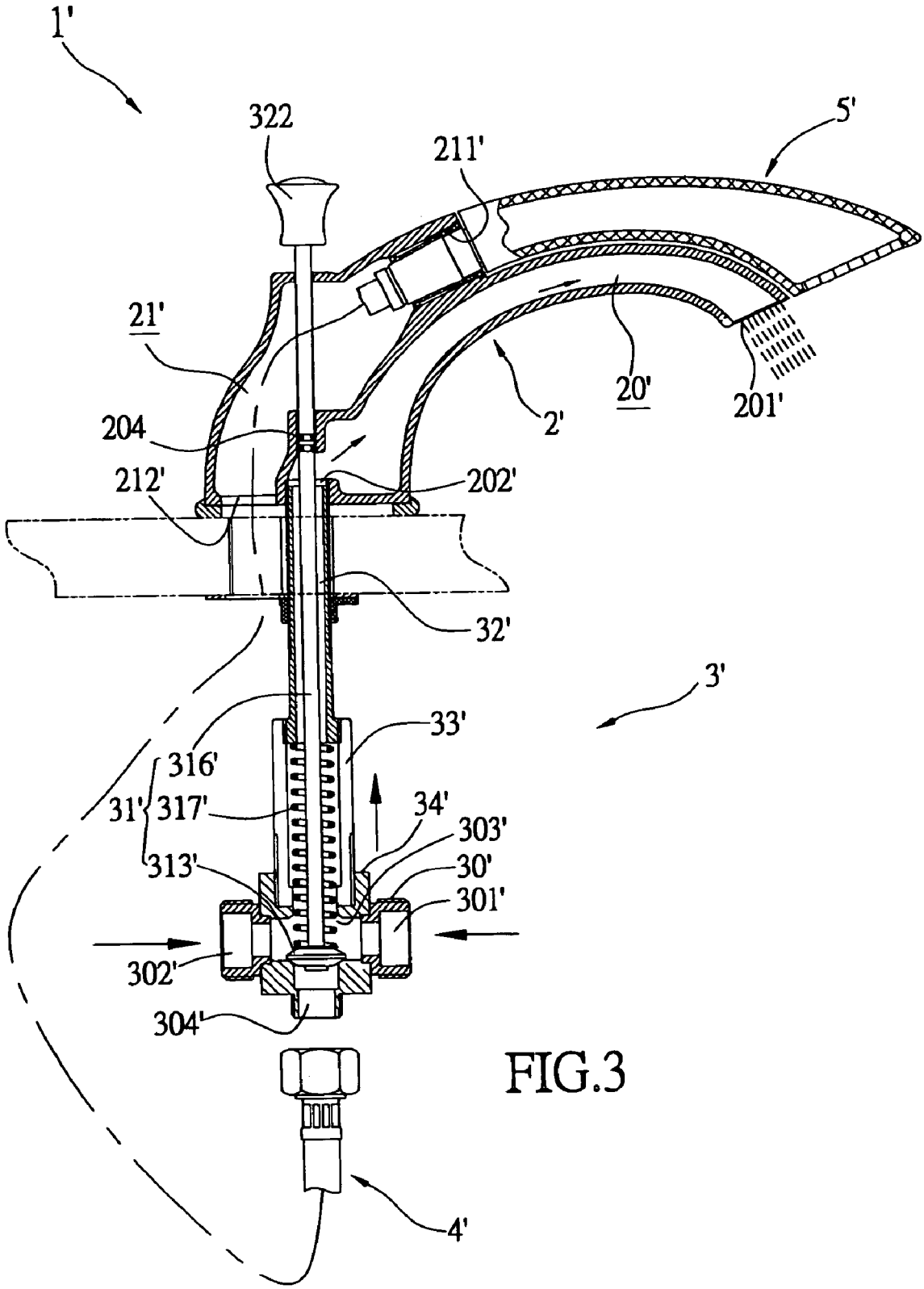
FIG. 3 is a cross sectional view of an alternative embodiment of the bathtub water tap in accordance with the present invention.

With reference to FIG. 3, an alternative embodiment of a bathtub water tap 1' in accordance with the present invention is a modification of the first embodiment. The same or similar components are designated with the same reference numerals as for the first embodiment, except followed by the symbol "'". The modification is implemented with a fluid control device 3'.

The fluid control device 3' includes two plumbing couplings 30', a piston mechanism 31', a mounting pipe 32', a receiving pipe 33' and a joint 34'. The mounting pipe 32', the receiving pipe 33' and the joint 34' are assembled in a manner as previously described. The piston mechanism 31' includes a piston body 313', a valve rod 316', a resilient member 317' and a knob 322.

The valve rod 316' is movable mounted and held in the pipes 32', 33' and the tap body 2' with multiple sealings such as O-rings 204 in the tap body 2'. The valve rod 316' has an outside end and an inside end. The outside end extends out of the tap body 2' onto which the knob 322 is attached. The inside end extends toward the showerhead outlet 304' onto which the piston body 313' is attached.

The resilient member 317' may be a compression spring and is mounted around the valve rod 316' between the piston body 313' and the mounting pipe 32' to provide a restitution force as previously described. Furthermore, the elastic coefficient of the resilient member 317' is less than the pressure of the water so that the piston body 313' can open the showerhead outlet 304' by pulling the valve rod 317' through the knob 322.

The piston body 313' closes the showerhead outlet 304' in a normal operation state, which results water flow enters through the receiving pipe 33', into the water passage 20', and then out from the outlet 201' for hip bath.

Figure 4:
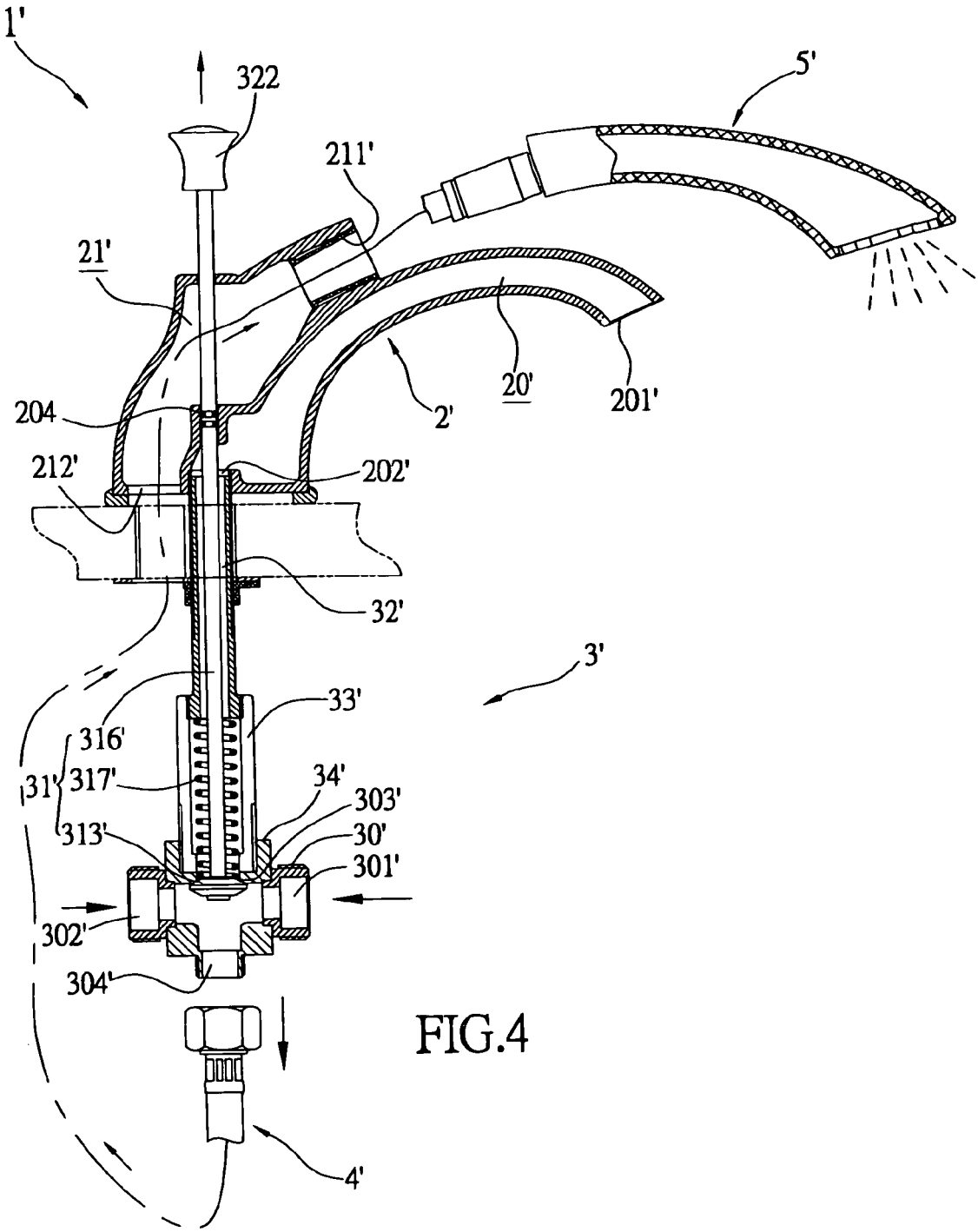
FIG. 4 is an operational, cross sectional view of the water tap in FIG. 3 when a showerhead is pulled out of a tap body.

With reference to FIG. 4, pulling upwardly the valve rod 316' lifts the piston body 313' to abut and close the tap body outlet 303', which results water flow enters through the showerhead hose 4' and out from the showerhead 5' for shower bath.

Figure 5:
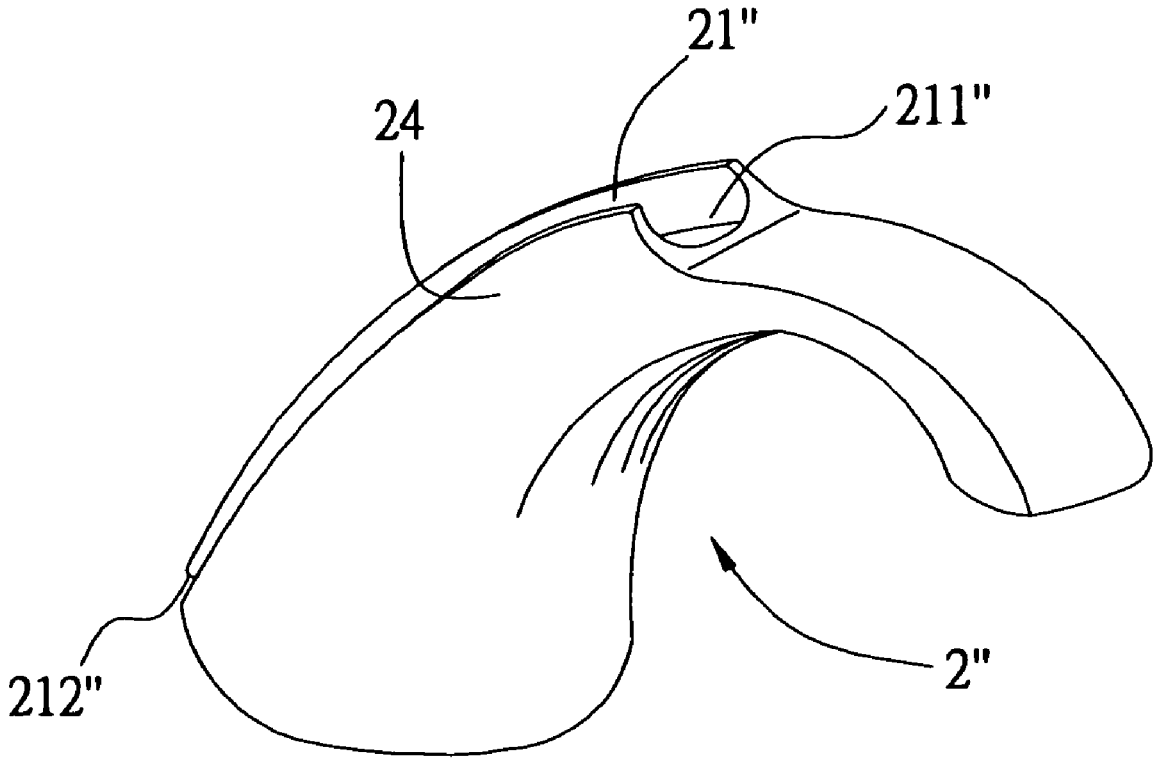
FIG. 5 is a perspective view of an alternative embodiment of the tap body in FIG. 1.

With further reference to FIG. 5, an alternative embodiment of a tap body 2" in accordance with the present invention is a modification of the tap body 2 of the first embodiment. The same or similar components are designated with the same reference numerals as for the first embodiment, except followed by the symbol "'".

The tap body 2" has two opposite upward wings 24. The wings 24 forms a hose passage 21", a socket hole 211" and a through hole 212" in the tap body 2" to receive the showerhead and the showerhead hose as previously described. The socket hole 211" and the through hole 212" communicate with the hose passage 21".

Consequently, the bathtub water tap 1, 1' in accordance with the present invention modularizes the tap body 2, 2', 2" and the showerhead 5, 5' for directly installing the showerhead 5, 5' at the tap body 2, 2', 2" when the showerhead 5, 5' is not in use. Additional installations of the showerhead 5, 5', such as drilling holes in the wall and driving screws are not required. Therefore, using and installing the bathtub water tap 1, 1' is more convenient and easy than a conventional bathtub water tap.

Furthermore, since the showerhead 5, 5' could be stored and hid in the tap body 2, 2', 2", the showerhead 5, 5' will not occupy bathroom space, and the appearance of the entire water tap 1, 1' is tidy and clean.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A bathtub water tap comprising:

a tap body having a hose passage, a water passage, an inlet and an outlet communicated with the water passage, and a socket hole and a through hole communicated with the hose passage;

a fluid control device connected to the inlet in the tap body;

a showerhead hose slidably mounted and held in the hose passage and having a first end and a second end passing respectively through the socket hole and the through hole in the tap body; and a showerhead attached to the first end of the showerhead hose and demountably mounted and held on the tap body;

wherein the second end of the showerhead hose is connected to the fluid control device, wherein the showerhead further has a spout face being flush with the outlet in the tap body when the showerhead is positioned on the tap body through the socket hole, and the showerhead and the tap body cooperatively form a complete profile.

2. The bathtub water tap as claimed in claim 1, wherein the hose passage is integrally defined in and completely through the tap body adjacent to the water passage and is shorter than the water passage in length; the through hole is defined adjacent to the inlet of the water passage; and the socket hole faces toward the outlet of the water passage.

3. The bathtub water tap as claimed in claim 1, wherein the showerhead further has an inside end demountably mounted and held in the socket hole in the tap body.

4. The bathtub water tap as claimed in claim 1, wherein the fluid control device comprises:

a joint having a tap body outlet and a showerhead outlet;

two plumbing couplings including a cold water inlet and a hot water inlet mounted in the joint, and the cold and the hot water inlets and the tap body and the showerhead outlets communicated with each other;

a receiving pipe mounted in the joint through the tap body outlet;

a mounting pipe connected to both the receiving pipe and the inlet of the water passage in the tap body; and a piston mechanism for selectively diverting water to one of the inlet in the tap body and the showerhead outlet in the joint.

5. The bathtub water tap as claimed in claim 4, wherein the piston mechanism comprises:

a valve rod movable mounted and held in the receiving pipe, the mounting pipe and the tap body and having an outside end extend out of the tap body and an inside end extended toward the showerhead outlet in the joint;

a knob attached to the outside end of the valve rod;

a piston body attached to the inside end of the valve rod and selectively closing one of the tap body outlet and the showerhead outlet in the joint; and a resilient member mounted around the valve rod between the piston body and the mounting pipe.

6. The bathtub water tap as claimed in claim 5, wherein the piston mechanism further comprises at least one sealing mounted around the valve rod in the tap body.

7. The bathtub water tap as claimed in claim 5, wherein the resilient member is a compression spring.

8. The bathtub water tap as claimed in claim 1, wherein the tap body further has two opposite wings formed upwardly, and the opposite wings form the hose passage, the socket hole and the through hole in the tap body.

9. A bathtub water tap comprising:

a tap body having a hose passage, a water passage, an inlet and an outlet communicated with the water passage, and a socket hole and a through hole communicated with the hose passage;

a fluid control device connected to the inlet in the tap body;

a showerhead hose slidably mounted and held in the hose passage and having a first end and a second end passing respectively through the socket hole and the through hole in the tap body; and a showerhead attached to the first end of the showerhead hose and demountably mounted and held on the tap body;

wherein the second end of the showerhead hose is connected to the fluid control device, wherein the tap body further has two opposite wings formed upwardly, and the opposite wings form the hose passage, the socket hole and the through hole in the tap body.

10. The bathtub water tap as claimed in claim 9, wherein the hose passage is integrally defined in and completely through the tap body adjacent to the water passage and is shorter than the water passage in length; the through hole is defined adjacent to the inlet of the water passage; and the socket hole faces toward the outlet of the water passage.

11. The bathtub water tap as claimed in claim 9, wherein the showerhead further has an inside end demountably mounted and held in the socket hole in the tap body.

12. The bathtub water tap as claimed in claim 9, wherein the showerhead further has a spout face being flush with the outlet in the tap body when the showerhead is positioned on the tap body through the socket hole, and the showerhead and the tap body cooperatively form a complete profile.

13. The bathtub water tap as claimed in claim 9, wherein the fluid control device comprises:

a joint having a tap body outlet and a showerhead outlet;

two plumbing couplings including a cold water inlet and a hot water inlet mounted in the joint, and the cold and the hot water inlets and the tap body and the showerhead outlets communicated with each other;

a receiving pipe mounted in the joint through the tap body outlet;

a mounting pipe connected to both the receiving pipe and the inlet of the water passage in the tap body; and a piston mechanism for selectively diverting water to one of the inlet in the tap body and the showerhead outlet in the joint.

14. The bathtub water tap as claimed in claim 13, wherein the piston mechanism comprises:

a valve rod movable mounted and held in the receiving pipe, the mounting pipe and the tap body and having an outside end extend out of the tap body and an inside end extended toward the showerhead outlet in the joint;

a knob attached to the outside end of the valve rod;

a piston body attached to the inside end of the valve rod and selectively closing one of the tap body outlet and the showerhead outlet in the joint; and a resilient member mounted around the valve rod between the piston body and the mounting pipe.

15. The bathtub water tap as claimed in claim 14, wherein the piston mechanism further comprises at least one sealing mounted around the valve rod in the tap body.

16. The bathtub water tap as claimed in claim 14, wherein the resilient member is a compression spring.

* * * * *